US006718659B2

(12) United States Patent
Foutz et al.

(10) Patent No.: US 6,718,659 B2
(45) Date of Patent: Apr. 13, 2004

(54) MATERIAL SEPARATING APPARATUS AND METHOD FOR USING SAME

(75) Inventors: Steve E. Foutz, Bloomfield, NM (US); Houston T. Barnes, Flora Vista, NM (US)

(73) Assignee: HTB, LLC, Flora Vista, NM (US)

( * ) Notice: Subject to any disclaimer, the term of this patent is extended or adjusted under 35 U.S.C. 154(b) by 0 days.

(21) Appl. No.: 10/242,896

(22) Filed: Sep. 11, 2002

(65) Prior Publication Data

US 2003/0014885 A1 Jan. 23, 2003

Related U.S. Application Data

(63) Continuation of application No. PCT/US01/08249, filed on Mar. 14, 2001.
(60) Provisional application No. 60/189,641, filed on Mar. 14, 2000.

(51) Int. Cl.[7] ..... E02F 5/22
(52) U.S. Cl. ..... 37/142.5
(58) Field of Search ..... 37/142.5; 209/325, 209/326, 331, 332, 365.1, 366, 366.5, 367, 421

(56) References Cited

U.S. PATENT DOCUMENTS

| | | | | |
|---|---|---|---|---|
| 683,775 | A | | 10/1901 | Kirkpatrick |
| 3,003,265 | A | | 10/1961 | Lutjens |
| 3,072,257 | A | | 1/1963 | Hockenberry |
| 3,395,798 | A | | 8/1968 | Erickson |
| 3,461,968 | A | | 8/1969 | Longley |
| 3,834,534 | A | * | 9/1974 | Peterson et al. ..... 209/326 |
| 4,116,014 | A | | 9/1978 | Satterwhite |
| 4,121,472 | A | * | 10/1978 | Vural et al. ..... 74/87 |
| 4,157,956 | A | | 6/1979 | Robinson |
| 4,287,056 | A | | 9/1981 | Dumbaugh et al. |
| 4,301,910 | A | | 11/1981 | Price |
| 4,363,725 | A | | 12/1982 | Morita et al. |
| 4,377,365 | A | | 3/1983 | Layh |
| 4,479,439 | A | | 10/1984 | Theurer et al. |
| 4,591,432 | A | | 5/1986 | Hartl |
| 4,632,751 | A | | 12/1986 | Johnson et al. |
| 4,633,602 | A | | 1/1987 | Layh et al. |
| 4,664,791 | A | | 5/1987 | McClain et al. |
| 4,698,150 | A | | 10/1987 | Wigoda |
| 4,698,925 | A | | 10/1987 | Jones et al. |
| 4,795,552 | A | | 1/1989 | Yun et al. |
| 4,805,703 | A | | 2/1989 | Carlsson |
| 4,861,461 | A | | 8/1989 | Utterback |
| 4,912,862 | A | | 4/1990 | Bishop et al. |
| 4,948,299 | A | | 8/1990 | Cronk, Jr. et al. |
| 4,961,542 | A | | 10/1990 | Den Besten et al. |
| 5,160,034 | A | | 11/1992 | Potter |
| 5,172,498 | A | | 12/1992 | Wack |
| 5,241,764 | A | | 9/1993 | Modig |
| 5,398,430 | A | | 3/1995 | Scott et al. |
| 5,405,092 | A | | 4/1995 | Jonninen |
| 5,493,796 | A | | 2/1996 | Ballew et al. |
| 5,544,435 | A | | 8/1996 | Somero |
| 5,581,916 | A | | 12/1996 | Hirose et al. |
| 5,590,482 | A | | 1/1997 | Peterson et al. |
| 5,743,030 | A | | 4/1998 | Sirr |
| 5,771,612 | A | | 6/1998 | Lynch |

FOREIGN PATENT DOCUMENTS

| | | |
|---|---|---|
| DE | 3101606 A1 | 8/1982 |
| GB | 1291555 | 10/1972 |
| HU | 205 405 B | 11/1991 |
| NL | 210651 | 8/1960 |
| NL | 218299 | 11/1961 |
| WO | WO90/12929 | 11/1990 |
| WO | WO97/15734 | 5/1997 |

* cited by examiner

*Primary Examiner*—Thomas B. Will
*Assistant Examiner*—Kristine Fiorio
(74) *Attorney, Agent, or Firm*—Deborah A. Peacock; Brian J. Pangrle

(57) ABSTRACT

A separating device and method for padding pipelines which attaches to a bucket and has a bottom support with sloping walls for directing the padding material. A shaker assembly having a screen a vibrator assembly is mounted on the bottom support, wherein at least one resilient mount is used to mount the shaker assembly to the bottom support.

10 Claims, 8 Drawing Sheets

MATERIAL SEPARATING APPARATUS AND METHOD FOR USING SAME

CROSS-REFERENCE TO RELATED APPLICATIONS

This application is a continuation of international application number PCT US 01/08249, filed Mar. 14, 2001.

This application claims the benefit of the filing of U S. Provisional Patent Application Serial No. 60/189,641, entitled "Material separating apparatus and method for using same," filed on Mar. 14, 2000, and the specification thereof is incorporated herein by reference.

BACKGROUND OF THE INVENTION

1. Field of the Invention (Technical Field):

The present invention relates to apparatus for separating material.

2. Background Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

U.S. Pat. No. 5,493,796, entitled "Pipeline padding apparatus," to Ballew and Barnes ('796 patent), discloses a material separating device. A corresponding Australian patent (Australian Patent No. 719,948) issued Aug. 31, 2000, the '796 patent and the corresponding Australian patent are incorporated herein by reference. These two patents disclose a padding apparatus attachable to a boom of an earth moving vehicle comprising a support frame comprising bucket forming end walls and side walls; a screen assembly mounted to the support frame; a vibrating assembly mounted on the exit side of the screen assembly for vibrating the screen assembly; and at least one resilient mount for mounting the screen assembly to the support frame. However, they do not disclose apparatus or methods for directing material exiting the screen. A need exists for apparatus and methods to direct such material, especially when the material is used as pipeline padding material in narrow pipeline trenches.

SUMMARY OF THE INVENTION (DISCLOSURE OF THE INVENTION)

The present invention comprises apparatus and methods for separating material, especially material for pipeline padding operations. In one embodiment, the apparatus is attachable to a boom of an earth moving vehicle for placing padding material and comprises a support frame, the support frame comprising at least one sloping wall for directing the padding material; a shaker assembly mounted to the support frame, the shaker assembly comprising a screen and a vibrator assembly mounted on the exit side of the shaker assembly for vibrating the shaker assembly, the vibrator assembly optionally comprising a vibrator mechanism which optionally comprises a hydraulic motor for rotating an eccentric shaft; and at least one resilient mount for mounting the shaker assembly to said support frame. According to this embodiment, the at least one sloping wall helps to direct padding material into, for example, a trench. Further, the support frame optionally comprises at least two sloping walls for directing padding material through an opening defined, for example, by the support frame. In this embodiment, the shaker assembly optionally comprises a shield for shielding the vibrator mechanism wherein the shield optionally comprises a concave cross-section. According to this embodiment, the support frame is preferably disposed below the shaker frame and the support frame is optionally mounted to a bucket wherein the bucket comprises a substantially open or openable bottom.

In another embodiment, the apparatus is attachable to a boom of an earth moving vehicle for placing padding material. In this embodiment, the apparatus comprises a support frame; at least one sloping wall for directing the padding material, the at least one sloping wall mounted to the support frame; a shaker assembly mounted to the support frame, the shaker assembly comprising a screen and a vibrating assembly mounted on the exit side of the shaker assembly for vibrating the shaker assembly, the vibrator assembly optionally comprising a vibrator mechanism which optionally comprises a hydraulic motor for rotating an eccentric shaft; and at least one resilient mount for mounting said shaker assembly to said support frame According to this embodiment and the aforementioned embodiment, the exit side of the shaker assembly is the side from which padding material exits the apparatus, for example, due to gravity.

According to this embodiment, the shaker assembly optionally comprises a shield for shielding the vibrator mechanism wherein the shield optionally comprises a concave cross-section. In addition, the support frame is optionally disposed below the shaker frame and the at least one sloping wall preferably extends below the shaker assembly, in particular the screen of the shaker assembly. In another embodiment, the at least one sloping wall is mounted to a bucket and/or a support frame and/or a shaker frame. According to various embodiments of the present invention, the at least one sloping wall is mounted to a component that is isolated (e.g., isolated by use of rubber mounts or the like) from vibrations of the shaker assembly In yet another embodiment, the support frame is mounted to a bucket wherein the bucket comprises a substantially open or openable bottom.

The present invention also comprises various methods. Such methods include a method of padding a trench comprising the steps of: attaching a bucket comprising a substantially open bottom to a tractor wherein the bucket comprises a padding apparatus that comprises a support frame mounted to the bucket, the support frame having at least two sloping walls for directing material; a shaker assembly mounted to the support frame, the shaker assembly comprising a screen and a vibrating assembly mounted on the exit side of the shaker assembly for vibrating the shaker assembly; and at least one resilient mount for mounting the shaker assembly to said support frame; loading material in the bucket; positioning the bucket above the trench; activating the vibrator assembly to facilitate segregation of material and thereby allow padding material to exit the bucket and enter the trench; and optionally tilting the apparatus fore or aft to better direct padding material into the trench. Of course, the tilting step optionally occurs during the positioning of the bucket during and/or before activation of the vibrator assembly A primary object of the present invention is to separate material.

A primary advantage of the present invention is the ability to direct separate material.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
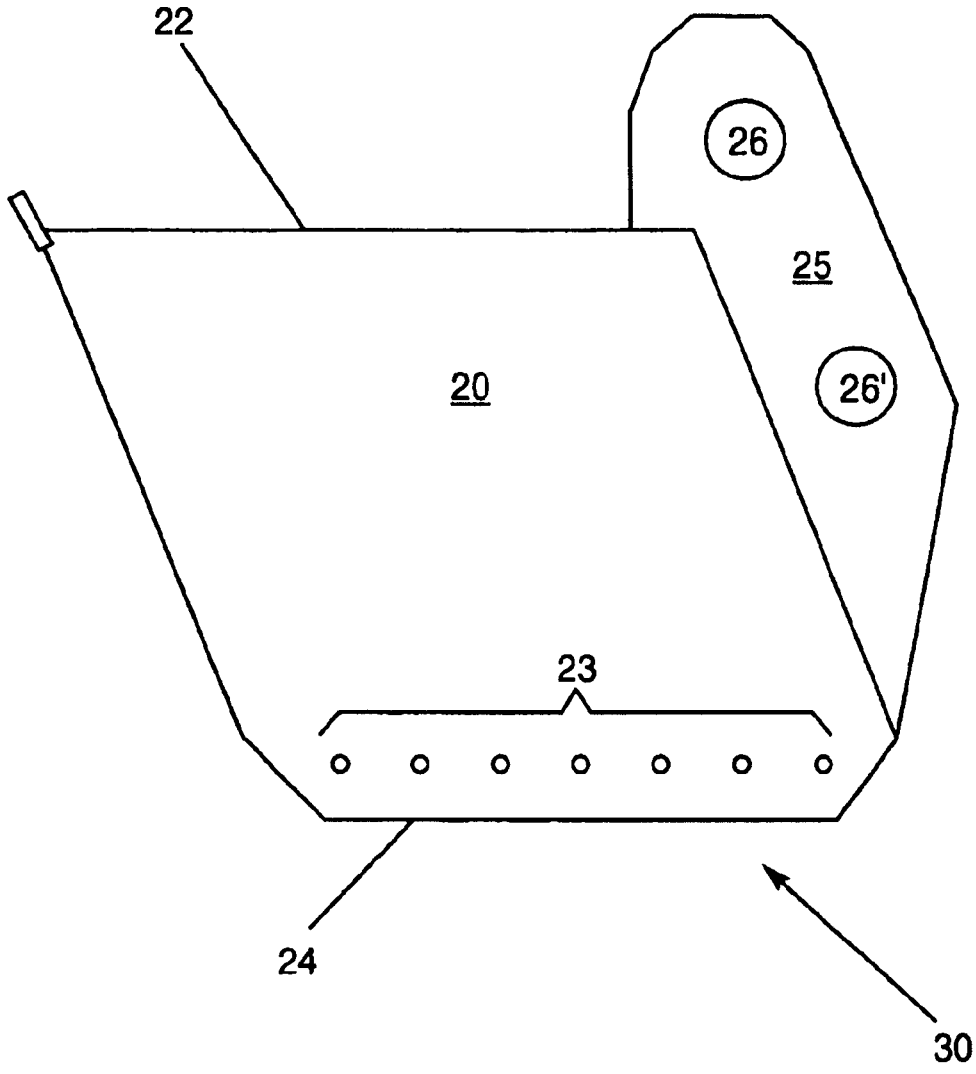
FIG. 1 is a side view of bucket according to an embodiment of the present invention.

DESCRIPTION OF THE PREFERRED EMBODIMENTS (BEST MODES FOR CARRYING OUT THE INVENTION)

The apparatus of the present invention is directed to the construction of berms. Berms constructed through use of the apparatus of the present invention are suitable for pipeline padding and a variety of other construction applications. In general, the apparatus of the present invention is useful for separating fine and coarse material and directing the fine material to a desired location. In pipeline applications, a berm is constructed in the bottom of a trench before a pipe is lowered into the same trench. This allows the pipe to have a void around it temporarily until additional material comprising, for example, padding or backfill has been placed around it. Industry standards have in the past encouraged contractors to have pipes placed from approximately 4" (10 cm) to approximately 12" (30 cm) above the bottom of a finished trench. This has traditionally been accomplished by either filling bags, for example, sandbags, with acceptable materials, or putting laborers into the trench with shovels to manually construct berms According to various embodiments of the present invention, the apparatus is useful for directing padding material into narrow trenches, especially when a tractor is positioned so as to straddle a trench. In such an operational configuration, the apparatus optionally comprises a rectangular opening wherein the width of the opening is substantially matched to the width of the trench and the length of the opening is positioned parallel to and substantially between the trench walls. Efficient operation results due to the ability to direct substantially all padding material into the trench In the case of a tractor positioned perpendicular to a trench, according to various embodiments, the apparatus is tilted in a fore to aft manner to direct padding material either primarily fore of a motor shield or aft of a motor shield. Alternatively, wherein the motor shield is approximately the width of the trench or larger, padding material is optionally directed to either side of the trench, for example, both fore and aft of the motor shield Such an operational procedure, or method, is useful when, for example, padding material and cover material are placed in the trench and next to the trench, respectively, in a single pass. In this procedural example, the trench is prepared for laying pipe and cover material is in place to simply move into the trench to cover the pipe once it has been laid in the trench.

According to various embodiments, the apparatus of the present invention helps reduce costs on a pipeline project by separating fine and coarse material and using the fine material for construction of berms in the bottom of trenches. Typically, such apparatus are useful to separate existing soils, and/or rocks, on site and to reduce risks to laborers by either reducing or eliminating the need to put them into a trench Thus, use of such apparatus is likely to reduce the number of work accidents. Such apparatus also reduce the amount of sloping required by contractors before an employee is placed in an excavation.

According to various embodiments, an apparatus of the present invention is attachable to the boom of an excavator and wherein the apparatus comprises a hydraulic motor, the motor is optionally powered, for example, by the hydraulic system already on the excavator. The hydraulic motor turns, for example, a shaft, which causes a screen to shake. The shaking screen allows fines to pass through the screen and to construct a berm of any desired size. Screens suitable for use with the present invention are optionally interchangeable to allow the apparatus to accommodate different sized openings and to achieve a desired size of fines.

An embodiment of the apparatus of the present invention is illustrated in FIGS. 1 through 7. In this particular embodiment, the apparatus features a bucket 20, a bottom frame 30, and a shaker assembly 41 The apparatus further includes a means for attachment to a tractor or the like The embodiment shown in FIG. 1 has at least one fin 25, which comprises at least one aperture 26, 26' for attachment to a tractor. As shown in FIG. 1, the bucket 20 comprises a top end 22 and a bottom end 24. The bottom frame 30 attaches to the bottom end 24 of the bucket 20, through, for example, a plurality of bolts 23 The bottom frame 30 is also referred to herein as a support frame, for supporting the shaker assembly 41.

Figure 2:
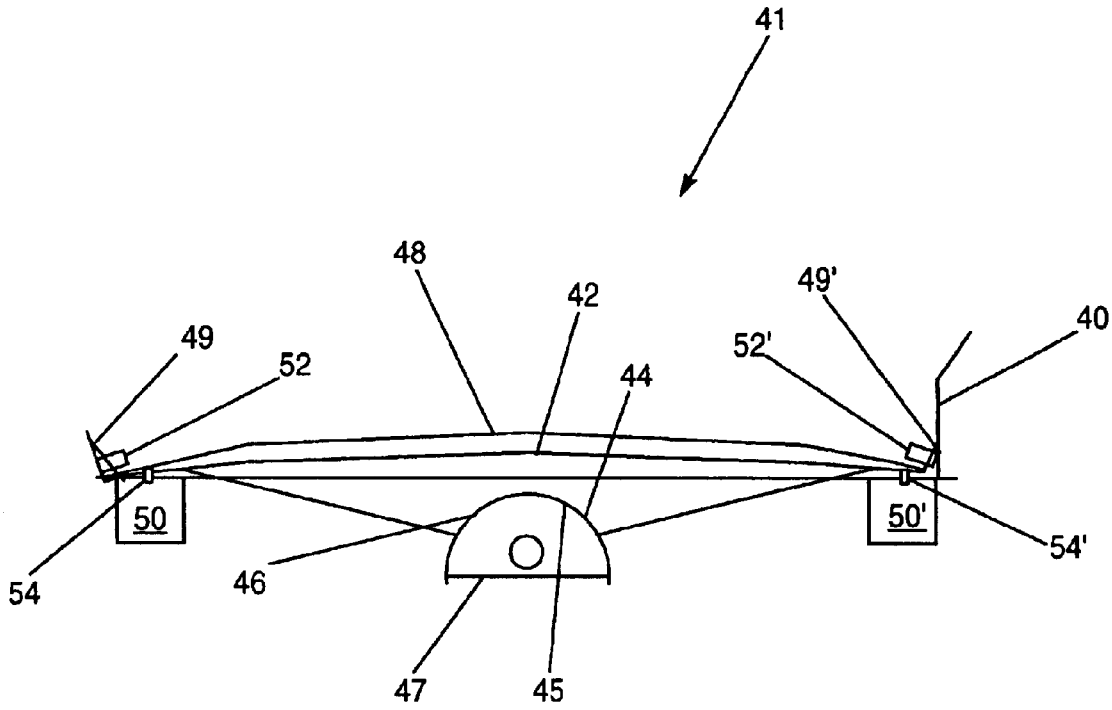
FIG. 2 is a cross-sectional side view of a shaker assembly according to an embodiment of the present invention.

A cross-sectional view of part of the shaker assembly 41 is shown in FIG. 2. The shaker assembly 41 comprises a shaker frame 40 that comprises a plurality of screen rub rails 42 and a shield 44. As shown in FIG. 2, the shield 44 has a semi-circular cross-section comprising concave 45 and convex sides 46. A motor mount 47 is mounted to the concave side 45 of the shield. A screen 48 is secured to the shaker frame 40 through use of two clamp rails, 49, 49'. The clamp rails are secured to the shaker frame 40 through use of tension bolts 52, 52'. Rubber mounts 50, 50' are also shown, which are disposed between the bottom frame 30 and the shaker frame 40 and attached to the shaker frame 40 through use of, for example, bolts 54, 54'.

Figure 3:
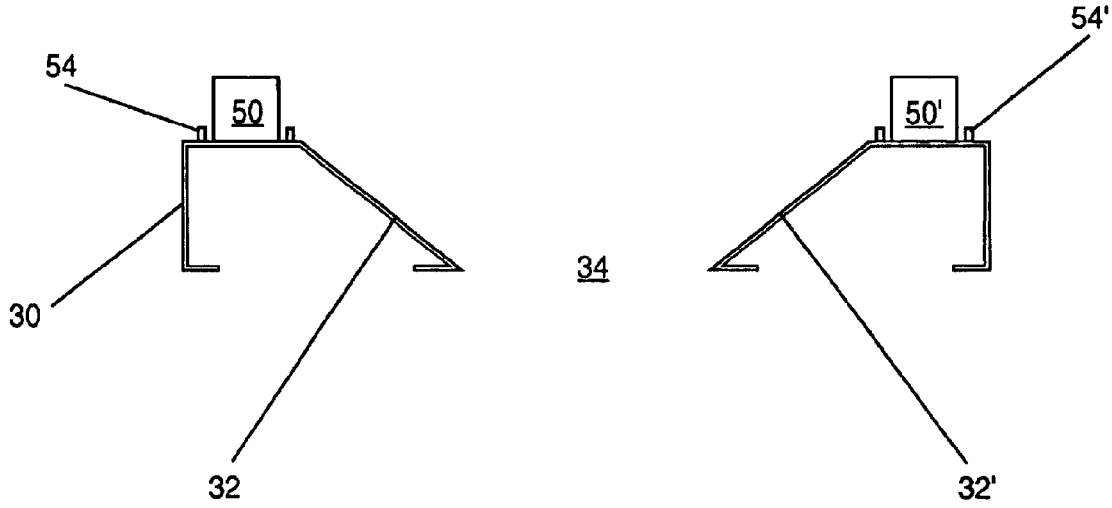
FIG. 3 is cross-sectional side view of a bottom frame according to an embodiment of the present invention.

Referring to FIG. 3, a cross-sectional view of the bottom frame 30 is shown. The bottom frame 30 has two sloping surfaces 32, 32' to direct material that passes through the screen 48 of the shaker assembly. Rubber mounts 50, 50' are also shown, which are disposed between the bottom frame 30 and the shaker frame 40 and attached to the bottom frame 30 through use of, for example, bolts 54, 54'

Figure 4:
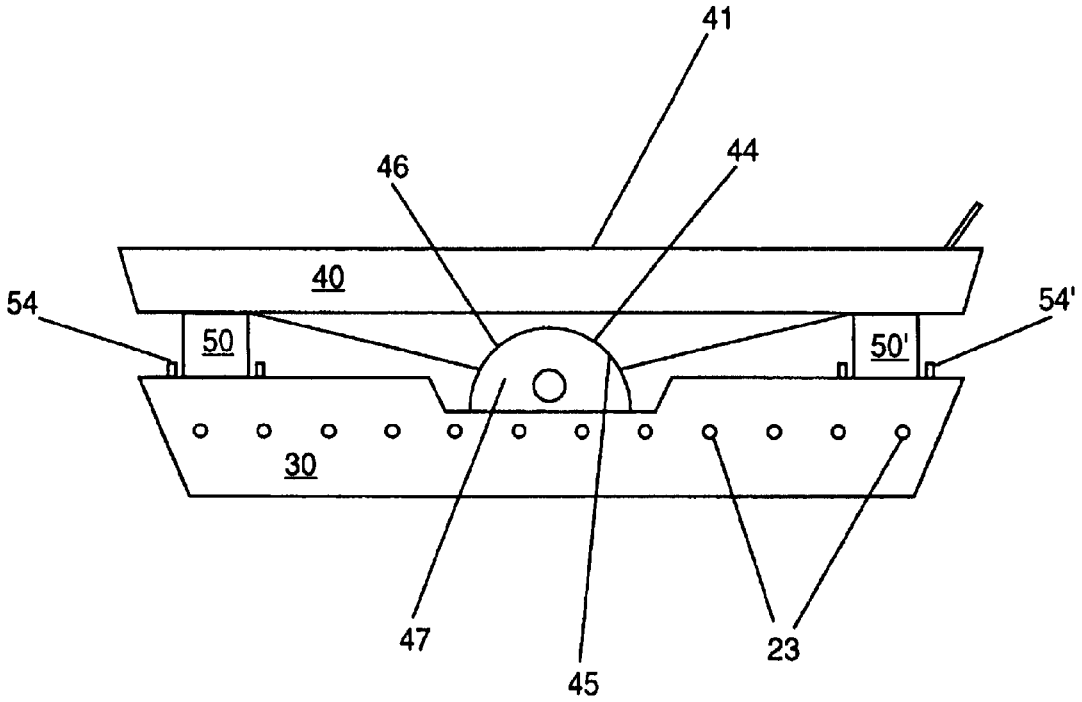
FIG. 4 is a side view of a bottom frame and shaker assembly according to an embodiment of the present invention.

Referring to FIG. 4, a side view of the bottom frame 30 attached to part of the shaker assembly is shown. The shaker frame 40 and the bottom frame 30 are connected through use of rubber mounts 50, 50' and bolts 54, 54'. The rubber mounts are optionally constructed of springs and/or other resilient material, not limited to, for example, rubber. The bottom frame 30 attaches to the bottom end 24 of the bucket 20, through, for example, a plurality of bolts 23.

Figure 5:
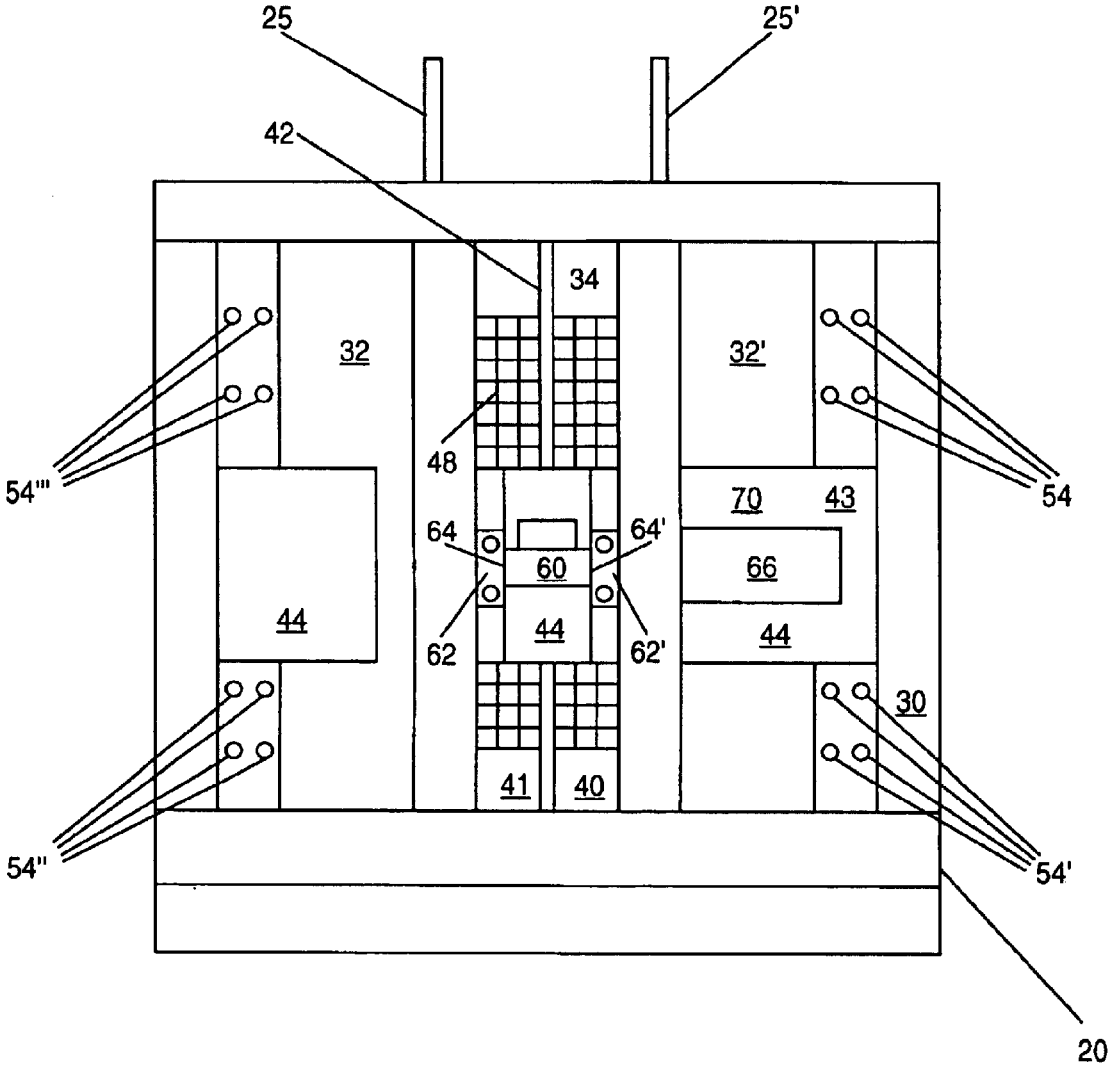
FIG. 5 is a bottom view of a bucket comprising a shaker assembly according to an embodiment of the present invention.

A bottom view of an embodiment of the bucket 20 is shown in FIG. 5. Extending from the back side of the bucket are two fins 25, 25' for attachment to a tractor or the like Shown in FIG. 5 are various components of the shaker assembly 41, including a vibrator assembly 43, which includes a motor 66, an eccentric shaft 60, bearings 64, 64', and bearing mounts 62, 62', which are all mounted substantially within the semi-circular shield 44. Of course shields comprising cross-sectional shapes other than semi-circular are also within the scope of the present invention, for example, but not limited to, triangular, rectangular, etc. The shield 44 helps to prevent material from contacting the motor 66, eccentric shaft 60, bearings 64, 64', and bearing mounts 62, 62'. An opening 34 is also shown in FIG. 5, through which part of the screen 68, part of the shaker frame 40 and a rub rail 42 are visible. In this embodiment, material passes either fore or aft of the shield 44 Thus, adjustment of the angle of the bottom end 24 of the bucket with respect to, for example, gravity, allows for control of material flow fore or aft of the shield 44.

Also shown in FIG. 5 are attachment points for four rubber mounts, see sets of bolts 54, 54', 54", 54'", which connect the bottom frame 30 to the rubber mounts.

Figure 6A:
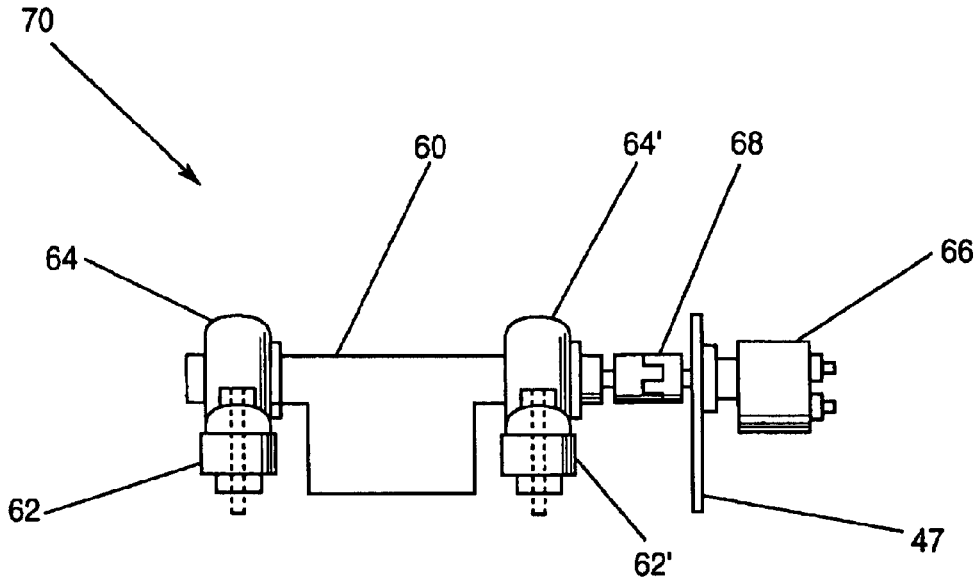
FIG. 6A is side view of a shaker mechanism according to an embodiment of the present invention.
Figure 6B:
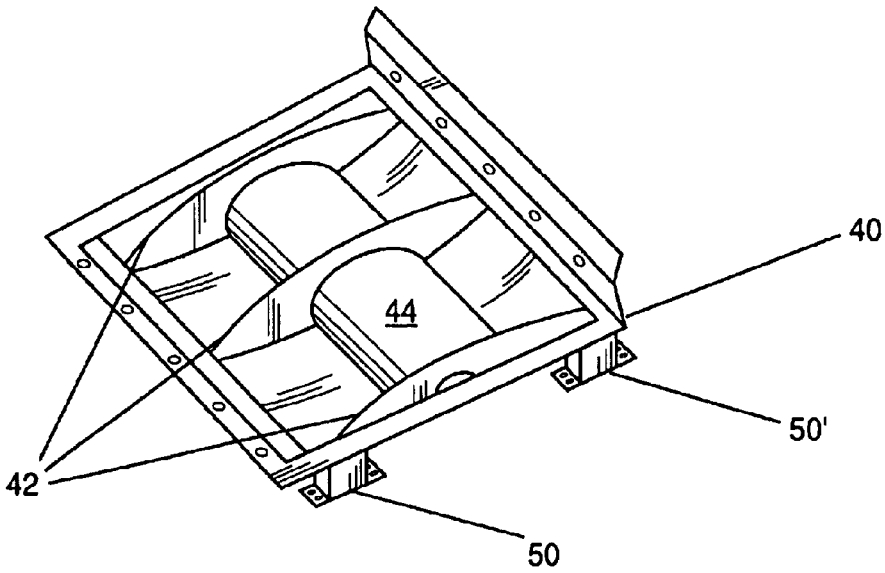
FIG. 6B is a perspective view of a shaker frame according to an embodiment of the present invention.

Additional views of the embodiment shown in FIGS. 1 through 5 are shown in FIG. 6. In particular, shown in FIG. 6A is a vibrator mechanism 70 of the vibrator assembly 43 for shaking the shaker frame 40 and the shaker assembly 41. According to this embodiment, the vibrator assembly 43 is a subassembly of the shaker assembly 41. The shaker mechanism 70 comprises an eccentric shaft 60 mounted between two bearings 64, 64' that are mounted on bearing mounts 62, 62'. The eccentric shaft is coupled to a motor 66 through a coupler 68. The motor is optionally driven through a hydraulic connection to a tractor. As shown in FIG. 6B, the shaker mechanism 70 is mounted under the shield 44 of the shaker frame 40, which is mounted to the bottom frame 30 through rubber mounts 50, 50'. Three screen rub rails 42, 42', 42" are also shown. Other means for vibrating the shaker assembly, known to one of ordinary skill in the art, are also within the scope of the present invention. Resilient mounts suitable for use in apparatus of the present invention include, but are not limited to, rubber mounts.

Figure 7:
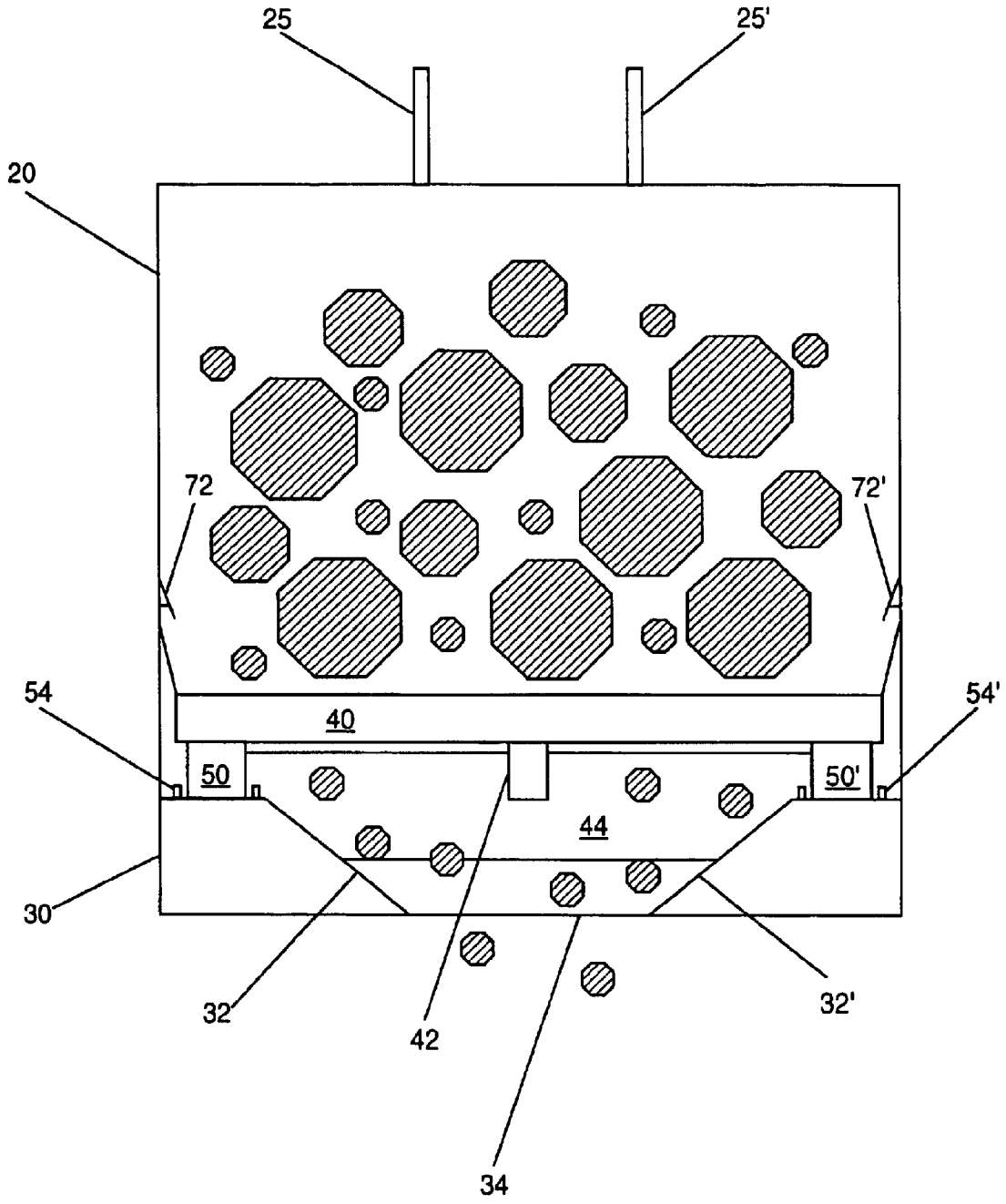
FIG. 7 is a cross-sectional view of bucket according to an embodiment of the present invention.

Shown in FIG. 7 is a cross-sectional end view of the embodiment shown in FIGS. 1 through 6. As shown, this embodiment comprises a bucket 20 partially filled with material. Rails 72, 72' help to prevent material from bypassing the screen mounted in the shaker frame 40. Rubber mounts 50, 50', bolt sets 54, 54', shield 44, a rub rail 42, and bottom frame 30 are also shown. Material passing through the shaker frame screen is deflected away from the shaker mechanism by the shield 44 and directed to the opening 34 by sloped walls 32, 32'.

Figure 8:
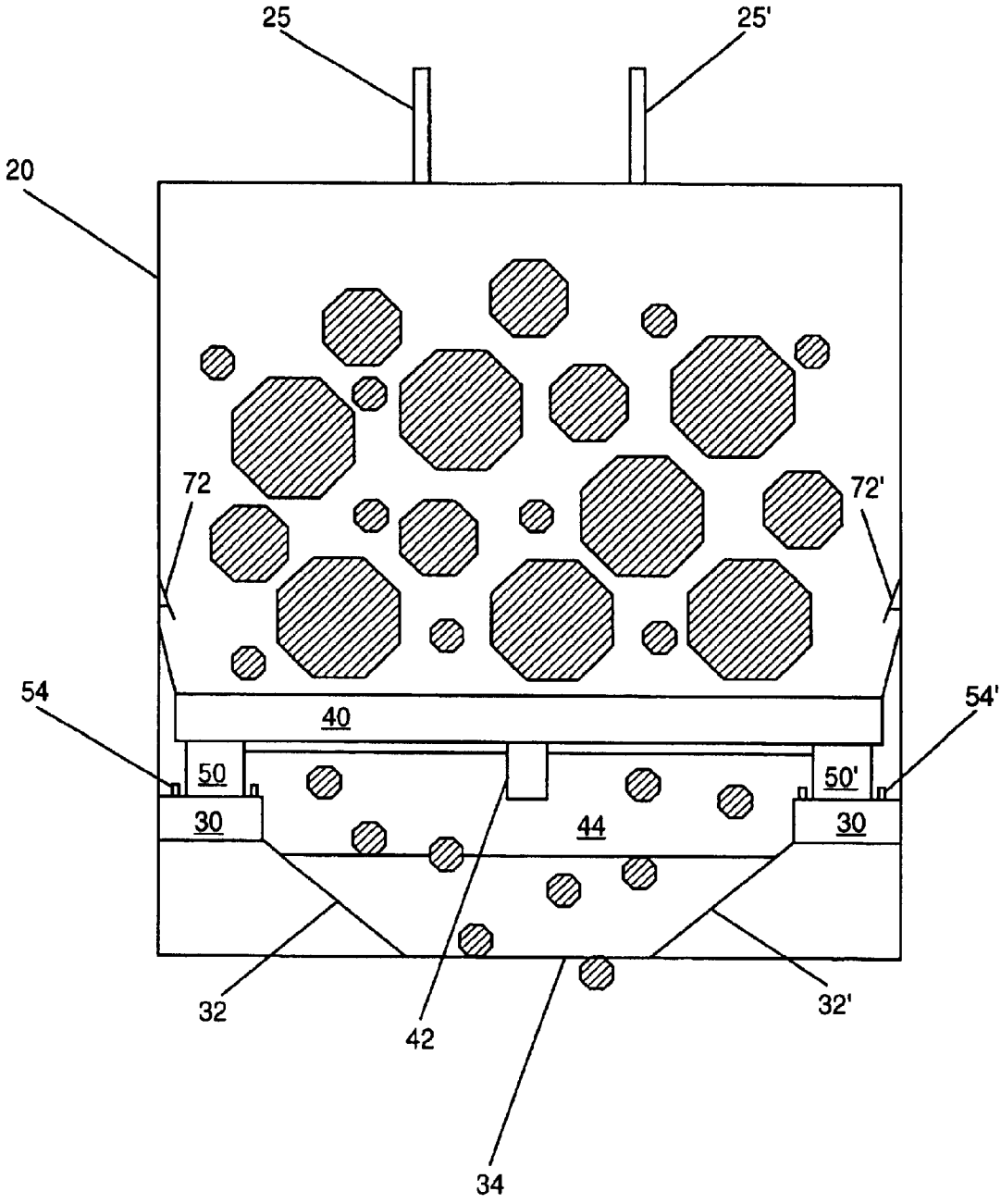
FIG. 8 is a cross-sectional view of bucket according to another embodiment of the present invention.

Shown in FIG. 8 is a cross-sectional end view of alternative to the embodiment shown in FIGS. 1 through 7. As shown, this embodiment comprises a bottom frame 30 and sloped walls 32, 32' that are attachable to the bottom frame for directing material through an opening 34. As in the embodiment of FIG. 7, material passing through the shaker frame screen is deflected away from the shaker mechanism by the shield 44 and directed to the opening 34 by sloped walls 32, 32'. In yet another embodiment, at least one sloped wall is attached to a bucket and/or a support frame for directing material through at least one opening.

In the embodiment, for example, as illustrated in FIG. 1 through FIG. 7 (as well as, in general, for the embodiment shown in FIG. 8), material is loaded into the bucket 20, the motor 66 is activated and fines are loosened and separated from the material and further directed through the screen 48 and through the opening 34 in the bottom frame 30.

In alternative embodiments, the orientation of the shield and the opening are optionally rotated by approximately 90 degrees with respect to a bucket. This allows for alignment of, for example, a rectangular opening with a trench when the apparatus is attached to a conventional tractor and the tractor is positioned to one side of the trench as opposed to straddling the trench In the embodiments shown, the bucket 20 is movable through attachment to, for example, a tractor. In particular, when attached to a tractor boom, the bucket 20 is movable with reference to the horizon. For example, the distance between a surface for fines deposition and the bottom of the invention apparatus is controllable. Furthermore, in one embodiment, the angle of the bottom of the bucket 20 with respect to a surface for fines deposition (and/or gravity) is controllable. Such control of the bucket 20 allows for loading the bucket 20, positioning the bucket 20, and controlling the flow of material from the bucket 20 to a selected surface for fines deposition and/or berm construction. For example, after loading the bucket 20, the front face of the bucket 20 is positioned substantially horizontal. The horizontal position helps to retain fines in the bucket 20. Once the bucket 20 is brought to the selected surface for fines deposition, the front face of the bucket 20 is positioned with a greater, more vertical angle This allows the loaded material to shift such that it rests primarily on the screen 48. Depending on the vertical angle, fines will emerge primarily from either the front of the opening 34, e g., fore of the motor shield (for example, for angles less than approximately 90 degrees from horizontal), the rear of the opening 34, e.g., aft of the motor shield (for example, for angles greater than approximately 90 degrees from horizontal) or both front and rear of the opening 34 (for example, for angles approximately 0 degrees from horizontal). Berm construction and/or fine deposition is controllable through such angular positioning of the apparatus. Furthermore, side to side rotations are also within the scope of the present invention. Such rotations are possible through use of bucket connectors known in the art. Berm construction and/or fines deposition is also controllable through adjustments of the distance between the bucket 20 and the surface for fines deposition or berm construction.

As mentioned above, the apparatus is useful for padding narrow trenches, especially when the apparatus is attached to a tractor that can straddle a trench and when the bottom opening of the apparatus is substantially the same as shown in FIGS. 1 through 8. According to the present invention, a method of padding comprises (i) positioning the tractor to straddle the trench; (ii) filling the bucket with material (e.g., turning the body of the tractor 90 degrees to the tractor tracks and scooping material with the bucket), (iii) positioning the bucket such that the opening is parallel to the trench line and substantially between the walls of the trench; and (iv) activating the vibrator to facilitate segregation of material and thereby allowing padding material to exit the bucket and enter the trench. According to this method, the tractor is simply optionally moved backward or forward following the trench line to achieve efficiency. In addition, the bottom of the bucket is optionally tilted fore or aft to further direct material from the apparatus to the trench.

Of course, the method is modifiable for instances wherein the tractor is positioned next to the trench and the opening of the apparatus is perpendicular to the trench In such instances, depending on the width of the trench, and/or area within the trench to be padded, tilting of the apparatus is useful to direct material from the apparatus to the trench.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus, attachable to a boom of an earth moving vehicle, for placing padding material comprising:

a support frame, said support frame comprising at least one sloping wall for directing the padding material;

a shaker assembly mounted to said support frame, said shaker assembly comprising a screen and a vibrator assembly mounted on the exit side of said shaker assembly for vibrating said shaker assembly, said vibrator assembly comprising a vibrator mechanism which optionally comprises a hydraulic motor for rotating an eccentric shaft;

at least one resilient mount for mounting said shaker assembly to said support frame; and wherein said shaker assembly further comprises a shield for shielding said vibrator mechanism.

2. The apparatus of claim 1 wherein said support frame further comprises at least two sloping walls for directing padding material through an opening.

3. The apparatus of claim 1 wherein said shield comprises a concave cross-section.

4. The apparatus of claim 1 wherein said support frame is disposed below said shaker frame.

5. The apparatus of claim 1 wherein said support frame is mounted to a bucket, said bucket comprising a substantially open bottom.

6. An apparatus, attachable to a boom of an earth moving vehicle, for placing padding material comprising:

a support frame;

at least one sloping wall for directing the padding material, said at least one sloping wall mounted to said support frame;

a shaker assembly mounted to said support frame, said shaker assembly comprising a screen and a vibrating assembly mounted on the exit side of said shaker assembly for vibrating said shaker assembly, said vibrator assembly comprising a vibrator mechanism which optionally comprises a hydraulic motor for rotating an eccentric shaft;

at least one resilient mount for mounting said shaker assembly to said support frame; and wherein said shaker assembly further comprises a shield for shielding said vibrator mechanism.

7. The apparatus of claim 6 wherein said shield comprises a concave cross-section.

8. The apparatus of claim 6 wherein said support frame is disposed below said shaker frame.

9. The apparatus of claim 6 wherein said support frame is mounted to a bucket, said bucket comprising a substantially open bottom.

10. A method of padding a trench comprising the steps of:

attaching a bucket comprising a substantially open bottom to a tractor wherein the bucket comprises a padding apparatus that comprises a support frame mounted to the bucket, the support frame having at least two sloping walls for directing material; a shaker assembly mounted to the support frame, the shaker assembly comprising a screen and a vibrating assembly mounted on the exit side of the shaker assembly for vibrating the shaker assembly, the vibrating assembly comprising a vibrator mechanism, and the shaker assembly further comprising a shield for shielding said vibrator mechanism; and at least one resilient mount for mounting the shaker assembly to said support frame;

loading material in the bucket;

positioning the bucket above the trench;

activating the vibrator assembly to facilitate segregation of material and thereby allow padding material to exit the bucket and enter the trench; and optionally tilting the apparatus fore or aft to better direct padding material into the trench.

* * * * *